US007228605B1

(12) United States Patent
Morton

(10) Patent No.: US 7,228,605 B1
(45) Date of Patent: Jun. 12, 2007

(54) METHOD OF FORMING A GEM SETTING

(75) Inventor: Curtis R. Morton, Macungie, PA (US)

(73) Assignee: Keystone Findings, Inc., Telford, PA (US)

( * ) Notice: Subject to any disclaimer, the term of this patent is extended or adjusted under 35 U.S.C. 154(b) by 87 days.

(21) Appl. No.: 10/376,946

(22) Filed: Feb. 28, 2003

(51) Int. Cl.
*A44C 27/00* (2006.01)
*A44C 9/00* (2006.01)
*A44C 17/02* (2006.01)

(52) U.S. Cl. ..... 29/10; 29/896.41; 29/896.412; 63/15; 63/26; 63/27

(58) Field of Classification Search ..... 29/10, 29/896.41, 896.42, 513, 413, 414, 896.412; 63/15, 26, 27; 72/379.2
See application file for complete search history.

(56) References Cited

U.S. PATENT DOCUMENTS

| | | | | |
|---|---|---|---|---|
| 2,003,950 | A * | 6/1935 | Pejchar | 63/27 |
| 3,261,072 | A * | 7/1966 | Stanley | 29/10 |
| 4,258,458 | A * | 3/1981 | Danna | 29/10 |
| D272,238 | S | 1/1984 | Liebrick et al. | |
| D277,085 | S | 1/1985 | Liebrick et al. | |
| 4,793,156 | A | 12/1988 | Pence | |
| 5,800,574 | A | 9/1998 | Ricci et al. | |
| D443,552 | S | 6/2001 | Lai | |
| 6,260,384 | B1 * | 7/2001 | Mino et al. | 63/26 |
| D457,091 | S | 5/2002 | Lai | |
| D457,092 | S | 5/2002 | Lai | |
| D457,832 | S | 5/2002 | Lai | |

FOREIGN PATENT DOCUMENTS

| | | | |
|---|---|---|---|
| GB | 2245814 A | * | 1/1992 |
| GB | 2270458 A | * | 3/1994 |

* cited by examiner

*Primary Examiner*—Jermie E. Cozart
(74) *Attorney, Agent, or Firm*—Fox Rothschild LLP; John P. Blasko

(57) ABSTRACT

Among other embodiment, disclosed herein is a setting for a gem formed from a blank, comprising a base formed from the blank and a negative impression forced against one another, at least three prongs formed from the blank and the at least one negative impression being forced against one another so that the at least three prongs extended radially from the base in a substantially coplanar manner, each of the at least three prongs having an end distal to the base, where the distal ends are forced to substantially face each other, and at least one receptacle end, formed from forcing a solid against the at least one of the distal ends, and adapted to confine the gem between the distal ends. A related method is also disclosed.

34 Claims, 14 Drawing Sheets

METHOD OF FORMING A GEM SETTING

BACKGROUND OF THE INVENTION

The invention disclosed herein relates generally to settings for confining articles, such as gemstones and other similar articles. More specifically, the invention relates to one-piece setting constructions and a method of stamping and pressing one-piece settings.

Settings, also referred to as findings by those in the jewelry industry, may be used to confine a gemstone or other ornamental article. Traditionally, the setting comprises a base with a number of prongs extending angularly upward from the base, where the ends of the prongs are used to confine the gem. In a diamond ring, for example, the base of the setting mounts to the ring shank, and the prong ends of the setting confine the diamond. The number of prongs and their placement on the perimeter of the base is dependent on the size and shape of the gem. The prongs may be straight, V-shaped, or shaped otherwise. V-shaped prongs may be used as a receptacle for confining the gem between the prong ends distal to the base.

Traditionally, there have been two methods of forming metal settings in the jewelry industry: casting and impressing. Casting generally relates to a method wherein metal is poured into a negative impression of a setting to form a positive copy of the setting. By contrast, impressing generally relates to a method wherein metals blanks are die-stamped, pressed, cut, trimmed, and/or folded, etc. in order to obtain a positive copies of setting components for future assembly into the final setting.

Both of these methods have their disadvantages. For example, the structure of a casted setting has a relatively high degree of porosity, thereby causing the casted setting to be weak and brittle. This high degree of porosity is inherent to the metallurgical structure of the casted setting. In addition, casted settings require substantial amounts of labor after the setting is casted, because the surfaces of casted settings are rough and the edges are ill-defined. These aesthetically displeasing characteristics often require laser polishing and/or other detailed and expensive attention before the setting is marketable.

Impressing, on the other hand, traditionally comprises the use of dies and presses to die-stamp a plurality of shapeable pieces from blank metal pieces. To build a setting, each of these plurality of pieces would be formed into the shape of half of a ring, with a prong on both ends (a "prong pair"). The prong pairs are then attached at their middles to form the appearance, but not the structure, of a single base with multiple pairs of prongs. Impressing does not require the shaping of melted metal and thus yields a metal setting of relatively low porosity. In addition, the structure of impressed blank metal is stronger than that of cast metal. Blank metal can be cut to form well-defined edges with surfaces that are not brittle. This facilitates minimal polishing subsequent to the impressing process. There is significant loss of metal in producing casted setting, and there is a substantial decrease in the amount of metal lost in the die stamping process.

For example, U.S. Pat. No. 5,800,574 ("'574 patent") discusses a setting and a method of making a setting having a conventional prong pair and a v-end prong pair. Each prong member has two prongs and is made from a single length of material. The V-end prong member is made by die pressing the material, blanking the material, and bending the material so that the V-ends face one another. The conventional prong member is attached to the central portion of a V-end prong member. Thus the '574 requires a minimum of two pieces of metal. It also requires the manual attachment of the metal pieces. U.S. Pat. No. 4,793,156 discloses further examples of settings that were formed utilizing the pressing, blanking, etc. of a plurality of metal pieces.

However, in the '574 patent, for example, the disclosed setting is not a unitary structure and still requires the step of attaching prong members together. This is an extremely cost-inefficient and labor-intensive method of forming metal settings. The attachment of prong members to each other requires that the prong members are soldered, jointed, or otherwise secured together. This requires the utilization of skilled tradesmen and, furthermore, may yield an aesthetically unpleasing setting, having superfluous solder, for example.

The present invention overcomes the collective disadvantages of both casting and impressing, and simultaneously embraces their collective advantages. Herein is disclosed a method of impressing a setting from as little as one piece of blank metal, thereby eliminating the cost-inefficiencies associated with attaching pieces, maintaining the high strength and relatively low porosity of impressed metal, and minimizing the possibility of sloppy, aesthetically unpleasing, soldering mistakes. Also disclosed is a method of impressing from a blank a setting having at least one receptacle end, such as a V-shaped receptacle end, for example. The method produces a setting, disclosed herein, that surpasses the prior art in terms of structure and method of manufacture.

SUMMARY OF THE INVENTION

Disclosed herein is a gem setting and a method of forming a gem setting from a blank. As used herein, the term "gem" is defined to comprise a gemstone or any other ornamental article, such as for example, a precious stone, a semi-precious stone, a pearl, etc.

In some embodiment, the setting and corresponding method of forming a setting for a gem from a blank, comprise forcing the blank and at least one negative impression against one another to form from the blank a base and at least three prongs each extending radially from the base in a substantially coplanar manner and each having an end distal to the base; forcing the distal ends to substantially face one another, and forcing a solid against at least one of the distal ends to form at least one receptacle end adapted to confine the gem between the distal ends.

In some embodiments, the setting and corresponding method comprises simultaneously pressing a male die against an inner surface of the at least one of the distal ends and securing a female die against an outer surface of the at least one of the distal ends. Also, in the some embodiment impressing means are used to force the blank and the at least one negative impression against one another. The negative impression may have a negative impression of the base as well as at least three prong impressions.

Some embodiments utilize shaping means to form at least one receptacle end from the at least one of the distal ends. Moreover, the distal ends may be shaped into at least one substantially V-shaped receptacle end. While the present invention only requires at least three prongs and at least one receptacle end, settings are contemplated by the present inventions that are suitable for princess-cut, marquis-cut, pear-cut (tear-cut), heart-cut, emerald-cut, trillion-cut, round-cut (e.g. 4 or 6 prongs), oval-cut, and/or other shapes and cuts. During the shaping of the setting, flash, also referred to as scrap, might be created. Flash may be removed as set forth herein. In some embodiments, the base is adapted for mounting on a conventional shank Also disclosed herein is a setting and method of forming a setting for a gem from a blank, comprising pressing the blank against a stamping die having a base negative impression and at least three prong negative impressions to form in the blank a base adapted for mounting in a conventional shank, flash, and at least three prongs each extending radially from the base in a substantially coplanar manner and each having an end distal to the base. In one embodiment, this method also comprises removing the flash, forcing the distal ends to substantially face one another, shaping the at least one of the distal ends into at least one substantially V-shaped receptacle by simultaneously pressing a male die against an inner surface of the at least one of the distal ends and securing a female die against an outer surface of the at least one of the distal ends, thereby forming additional flash, and removing the additional flash. In some embodiments, this method also comprises annealing the base and the at least three prongs. The method may also comprise shaping the at least one of the distal ends into the at least one substantially V-shaped receptacle and shaping the four distal ends into four substantially V-shaped receptacles.

In some embodiments, the disclosed settings and methods comprises providing a partially-formed setting having a base and at least three prongs each extending radially from the base in a substantially coplanar manner and each having an end distal to the base, forcing the distal ends to substantially face one another, and forcing a solid against at least one of the distal ends to form at least one receptacle end adapted to confine the gem between the distal ends. The partially formed setting may, for example, be impressed metal or casted. Further, depending on the embodiment, the at least one of the distal ends are shaped into a substantially V-shaped receptacle end. In some embodiments, there are four prongs and four substantially V-shaped receptacle ends. In some embodiments, the base is adapted to be mounted in a conventional shank.

In some embodiments, a setting and method of forming a setting for a gem from a blank comprises forcing the blank and at least one negative impression against one another to form from the blank a base adapted for mounting in a conventional shank and to form from the blank at least three prongs each extending radially from the base in a substantially coplanar manner and each having an end distal to the base and forcing the distal ends to substantially face one another. Impressing means may be used to force the blank and the at least one negative impression against one another. In some embodiments, forcing the blank and the at least one negative impression against one another comprises pressing the blank against a stamping die having a base negative impression and at least three prong negative impressions. In some embodiments, the setting and method involve annealing the base and the at least three prongs.

These and other features and objects of the invention will be more fully understood from the following detailed description of the preferred embodiments, which should be read in light of the accompanying drawings.

BRIEF DESCRIPTION OF THE DRAWINGS

The accompanying drawings, which are incorporated in and form a part of the specification, illustrate the embodiments of the present invention and, together with the description serve to explain the principles of the invention. In the drawings.

DETAILED DESCRIPTION OF THE INVENTION

Figure 1A:
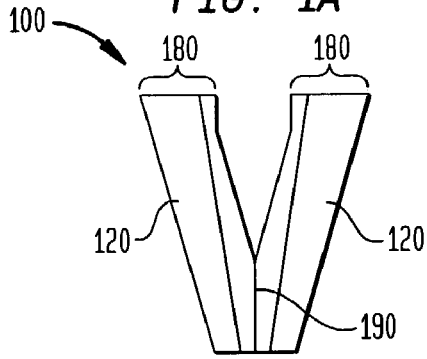
FIG. 1*a* is a side view drawing showing an embodiment of a setting.

In describing an embodiment of the invention illustrated in the drawings, specific terminology will be used for the sake of clarity. However, the invention is not intended to be limited to the specific terms so selected, and it is to be understood that each specific term includes all technical equivalents which operate in a similar manner to accomplish a similar purpose.

Figure 1B:
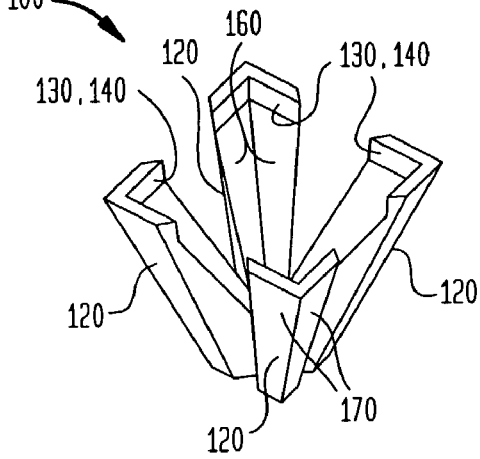
FIG. 1*b* is a perspective view drawing showing an embodiment of a setting.
Figure 1C:
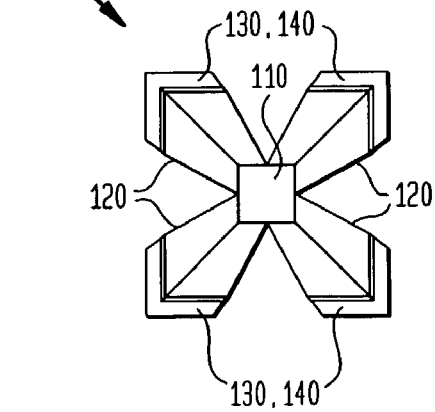
FIG. 1*c* is a top view drawing showing an embodiment of a setting.
Figure 1D:
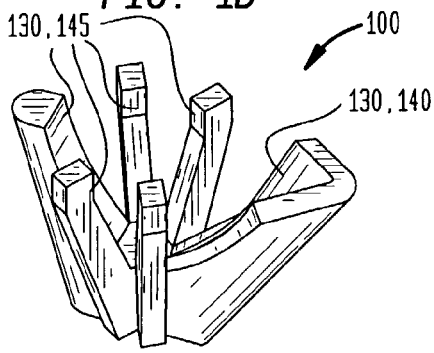
FIG. 1*d* is a perspective view drawing showing another embodiment of a setting.
Figure 1E:
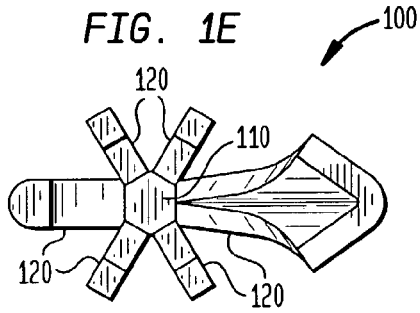
FIG. 1*e* is a front view drawing showing another embodiment of a setting.
Figure 1F:
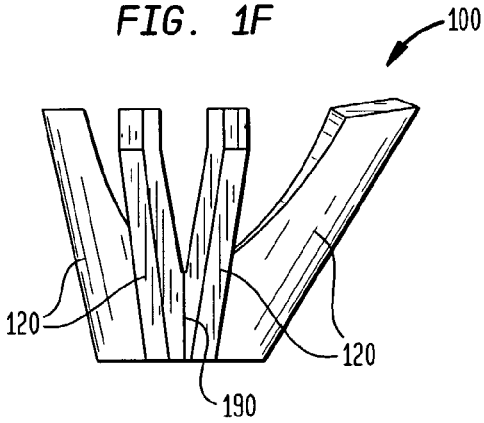
FIG. 1*f* is a right side view drawing showing another embodiment of a setting.
Figure 1G:
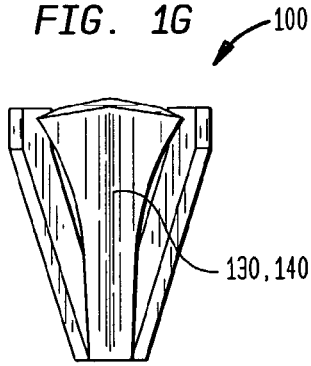
FIG. 1*g* is a front view drawing showing another embodiment of a setting.

FIGS. 1*a*–1*c* show an embodiment of the setting 100 as formed by the method described herein. The setting 100 comprises a base 110 and at least three prongs 120. Each prong 120 comprises an end distal to the base 110, referred to as a distal end 130. In the embodiment shown in FIGS. 1*a*–1*c*, the setting 100 comprises four prongs 120 having four distal ends 130. In any event, at least one of the distal ends 130 comprises a receptacle end 140. FIG. 1*b* illustrates the inner surface 160 of receptacle end 140 and the outer surface 170 of receptacle end 140, which will be discussed in further in detail in conjunction with FIGS. 7*a*–7*c*. Also, FIG. 1*a* illustrates the prongs tops 180 which will be discussed in further in detail in conjunction with FIGS. 10*a*–10*c*.

The sample embodiment shown in FIGS. 1*a*–1*c* has four receptacle ends 140, each end being shown in a substantially V-shaped embodiment. This embodiment would be particularly well suited for a princess-cut gem, for example. A receptacle end, such as receptacle end 140 for example, is adapted to confine a gem between the distal ends 130. A diamond, for example, can be placed between all distal ends 130 and then the metal of the receptacle end 140, such as that of a V-shape for example, can be folded down over the diamond to facilitate the confinement of the diamond. In one embodiment, a receptacle end 140 is adapted to enclose the corner of the gem, such as a marquise- or trillion-cut gems, for example. The receptacle end may also be positioned at a curved edge, such as in the case of an oval-cur gem, for example.

In the embodiment shown in FIGS. 1*a*–1*c*, all four distal ends 130 comprise receptacle ends 140. For the purpose of clarity, FIGS. 1*a*–1*c* and other figures have been chosen to show an embodiment of a setting 100 with four prongs 120 and four receptacle ends 140. However, the current invention relates to a setting with any number of prongs so long as there are at least three prongs 120 and at least one receptacle end 140. The gem setting 100 is not limited in size. Embodiments of setting 100 and the methods herein disclosed can be utilized for any shaped gem. This may include, by way of illustration and without limitations, princess-cut, marquis-cut, pear-cut (tear-cut), heart-cut, emerald-cut, trillion-cut, round-cut (e.g. 4 or 6 prongs), oval-cut, and/or other shapes and cuts.

FIGS. 1*d*–1*g* show another sample embodiment of a setting 100, this sample has six prongs 120, six distal ends 130, and one receptacle end 140. Notice that distal ends 130 have five conventional prong ends 145. This configuration of conventional prong ends 145 and receptacle prong ends 140 is a particularly well-suited embodiment for setting a pear-cut or tear-shaped gem. The single receptacle end 140 is adapted to confine the end of the pear shape, with the body of the pear-shape is confined against the conventional prongs 145 of distal ends 130.

In all embodiments of setting 100, each distal end 130 is forced to substantially face each other distal end 130. As used herein, the terminology "substantially face" means that the distal ends 130 must face each other to the degree necessary to confine a gem placed between the distal ends 130. This degree is largely dependent on the size of the gem, the size of the setting 100, the spacing between the distal ends 130, and the number of distal ends 130. For example, the relationship between the lines of sight of each distal end 130 would be different for a setting 100 adapted for a heart-cut gem than it would be for a setting 100 adapted for an emerald-cut gem.

A method of making a sample embodiment of the setting 100 will now be discussed with references to the figures. FIGS. 2–7*c* and 9*a*–11*c* are particularly useful as a collective whole for viewing one embodiment of the progression of the blank metal from start to finish, as it is shaped, folded, forced, pressed, etc.

Figure 2:
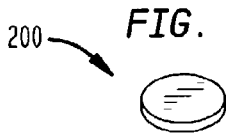
FIG. 2 is a perspective view drawing showing an embodiment of a blank.

Referring to FIG. 2, an embodiment is shown of the blank 200 that is ultimately is formed into setting 100. One embodiment of blank 200 is shown to be cylindrically shaped, however in some embodiments, the blank 200 is shaped otherwise. In one embodiment, the blank 200 comprises gold, however in other embodiment, the blank comprises other metals, such as a precious metal or alloy for example. The exact dimensions of the blank 200 are dependent on the size of the setting 100. In some embodiments, the blank has been annealed before it is formed to reduce any chance of the metal cracking. In some embodiments, the metal is annealed many times throughout the process described herein.

Figure 3A:
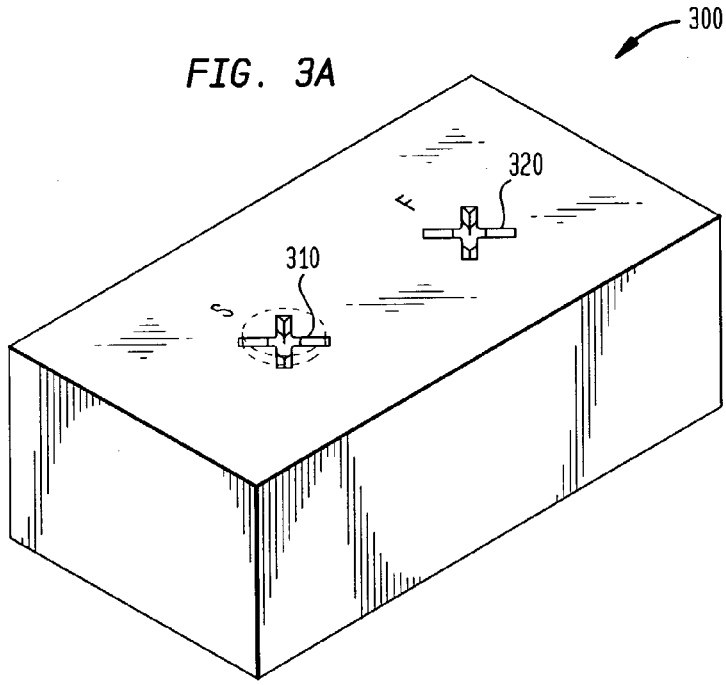
FIG. 3*a* is a perspective view drawing showing an embodiment of a stamping die.
Figure 3B:
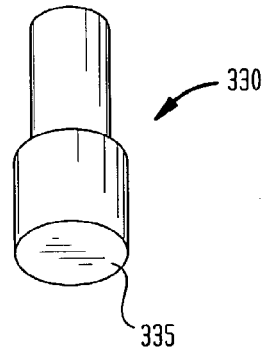
FIG. 3*b* is a perspective view drawing showing an embodiment of a press piece.
Figure 3C:
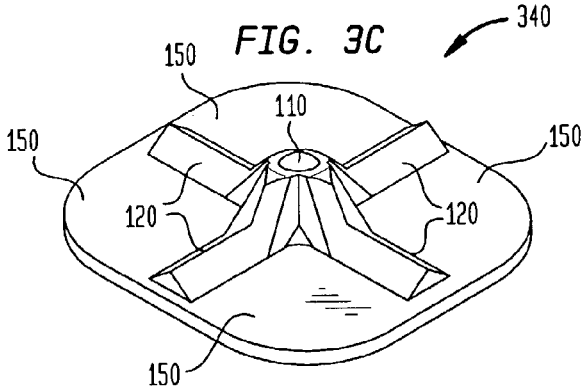
FIG. 3*c* is a perspective view drawing showing an embodiment of the impressed metal.

FIGS. 3*a*–3*c* show a stamping die 300, press piece 330, and the impressed metal 340. The blank 200 and a negative impression, such as that of stamping die 300, for example, are forced against one another to impress the metal with the base 110 and the at least three prongs 120, where each prong 120 extends radially from the base 110 in a substantially coplanar manner. In some embodiments, stamping die 300 comprises a starting (S) negative impression 310 and a final (F) negative impression 320. This is so that the blank 200 may be stamped twice, each time with a little more detail. Double-stamping facilitates better-defined edges. Moreover, in some embodiments, the blank is stamped a total of three times: twice in the S negative impression 310 and then once in the F negative impression 320. Each of the S negative impression 310 and the F negative impression comprise a negative impression of the base and the prongs.

In one embodiment, the press piece 330 has a flat surface 335 and is adapted to be fitted to a press machine. The press piece 330 is used to press the blank 200 into at least one of negative impression 310 and negative impression 320. Other mean of impressing the blank with a base and prongs are contemplated by the current invention and known to those skilled in the art. In some embodiments, forcing the blank and the negative impression against one another will create flash 150, as seen in FIG. 3*c*. 3*c* shows a partially-formed setting comprising impressed metal 340.

In some embodiments, forcing the blank and the negative impression against one another will form a base 110 and prongs 120 without any flash 150. FIG. 5*c* illustrates one embodiment of flashless metal 530. The presence or absence of flash 150 is dependent on many factors known in the art, including by way of illustration without limitation, the shape of the blank, the shape of the negative impression, and the means for forcing the blank against the negative impression.

The impressed metal 340 and/or flashless metal may be referred to as a partially-formed setting. Metal that has been even further shaped almost to final form is referred to in the industry as near net form. The partially-firmed setting and near net form settings may be formed by methods other than by die-stamping, for example. A finished setting 100 or a near net form may be made by, for example, casting the shape and/or sintering metal powder. The resulting blank setting or near net form may then be die stamped or coined, for example, to the desired final finished form of setting 100. Such methods and structures are contemplated within the scope of some embodiments of the present invention.

Figure 4A:
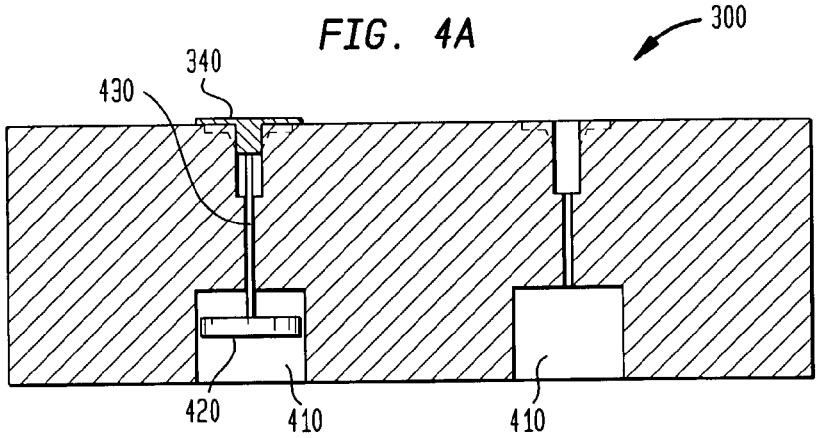
FIG. 4*a* is a side cross-sectional view drawing showing an embodiment of the push-pin in a lowered position.
Figure 4B:
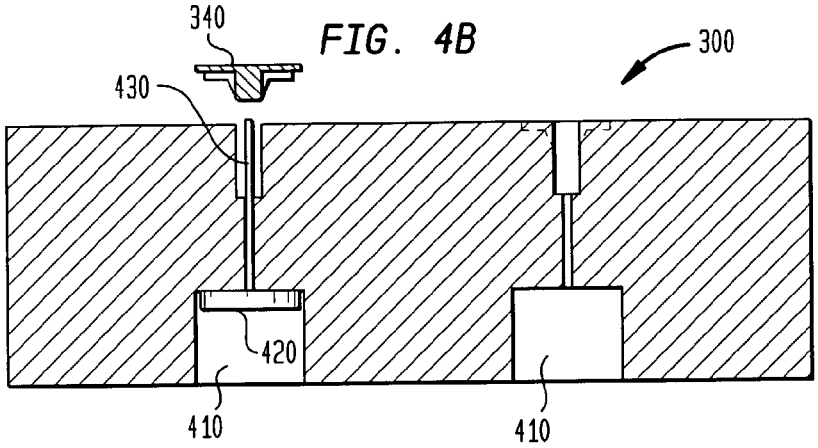
FIG. 4*b* is a side cross-sectional view drawing showing an embodiment of the push-pin in a raised position.
Figure 4C:
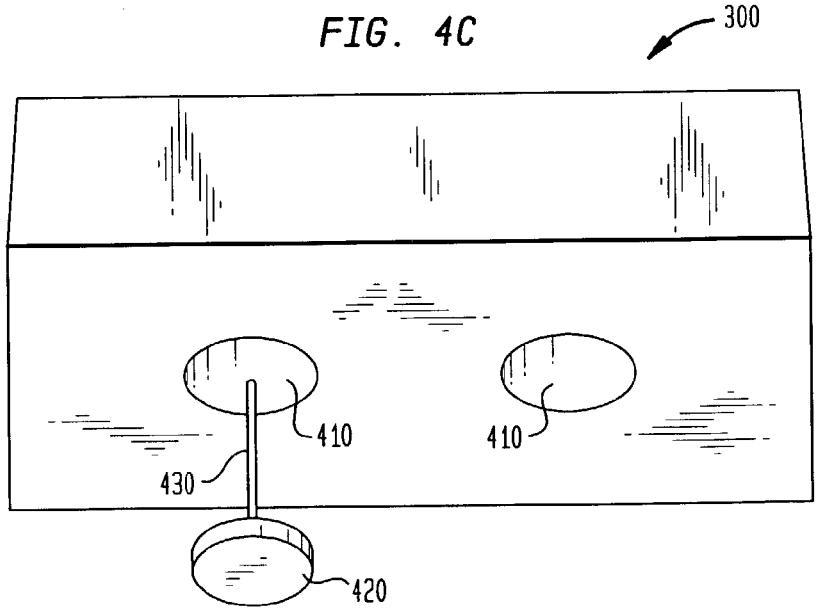
FIG. 4*c* is bottom side perspective view drawing showing an embodiment of the stamping die.

FIGS. 4*a*–4*c* illustrate one embodiment for extracting the blank metal from a die with a push-pin. While the illustrated embodiment shows the push-pin being used in conjunction with the stamping die 300, the push-pin may be utilized with an die described herein and is operable by a user, manually or by automatic means. In the illustrated embodiment, for example, a push-pin comprising a push 420 and a pin 430 is inserted into a passage 410 that is wide at the bottom for allowing the passage of both the push 420 and the pin 410, but narrower further up to only allow passage of the pin 430. In one embodiment, a die has one passage corresponding to each recess/impression on the die's face. Referring to FIG. 4*a*, the push-pin is in a lowered position when the metal, such as when the blank 200 is being forced into the impressed metal 340. Once done with the die, such as the stamping die 300, for example, the push-pin is operated to raise, whereby the pin 430, presses the impressed metal 340 our from the recess. This is illustrated in FIG. 4*b*.

Figure 5A:
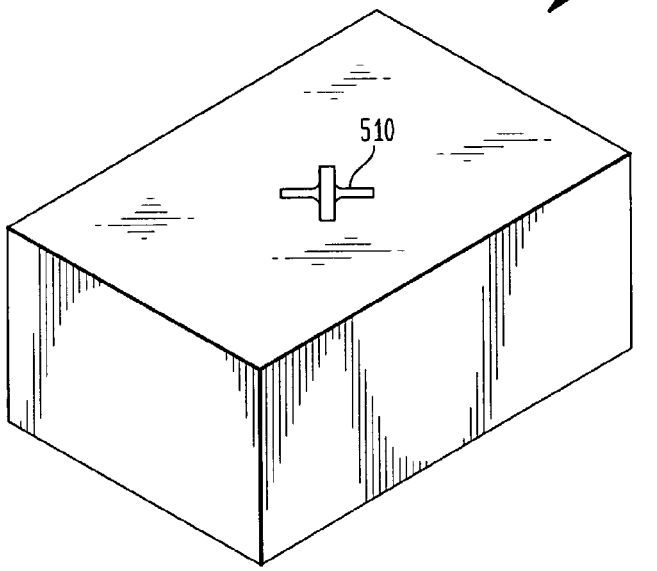
FIG. 5*a* is a perspective view drawing showing an embodiment of a die adapted for punching.
Figure 5B:
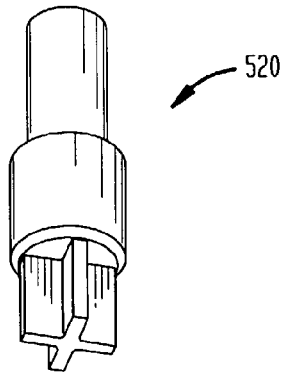
FIG. 5*b* is a perspective view drawing showing an embodiment of a punch press piece.
Figure 5C:
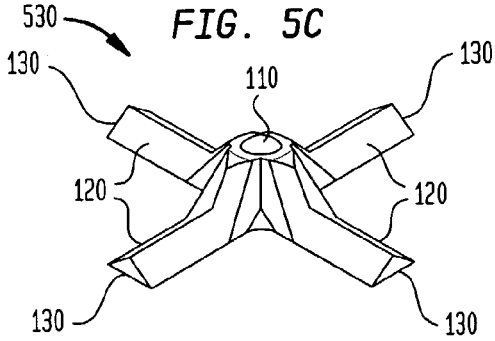
FIG. 5*c* is a perspective view drawing showing an embodiment of the flashless metal.

FIGS. 5*a*–5*c* illustrate one embodiment for removing any flash 150 that may have been formed from the blank 200. In one embodiment, the impressed metal 340 is inserted in the impression 510 of a die for punching 500 and a punch press piece 520 is used is used with a press machine to remove the flash 150 by punching it away. This forms another embodiment of a partially-formed setting, such as one with flashless metal 530. The flashless metal 530 comprises a base 110 and prongs 120. It is contemplated that removing any flash 150 may be accomplished by cutting, punching, and/or any other means or process known in the art.

Figure 6A:
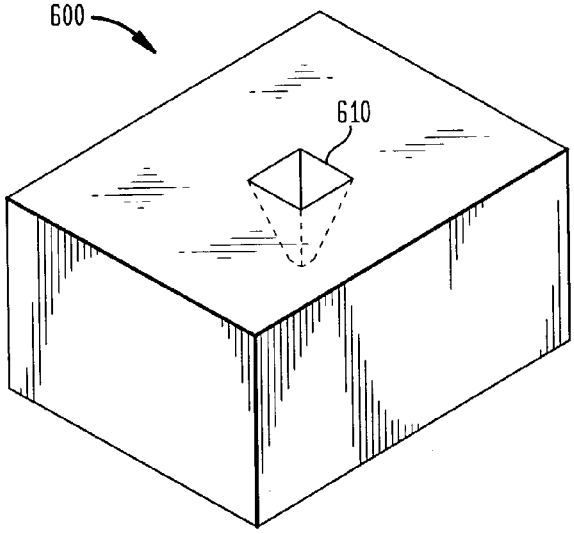
FIG. 6*a* is a perspective view drawing showing an embodiment of a die adapted for folding.
Figure 6B:
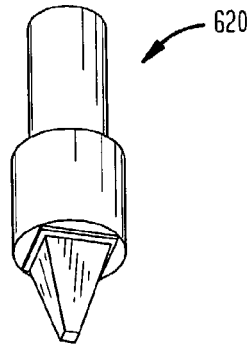
FIG. 6*b* is a perspective view drawing showing an embodiment of a press piece.
Figure 6C:
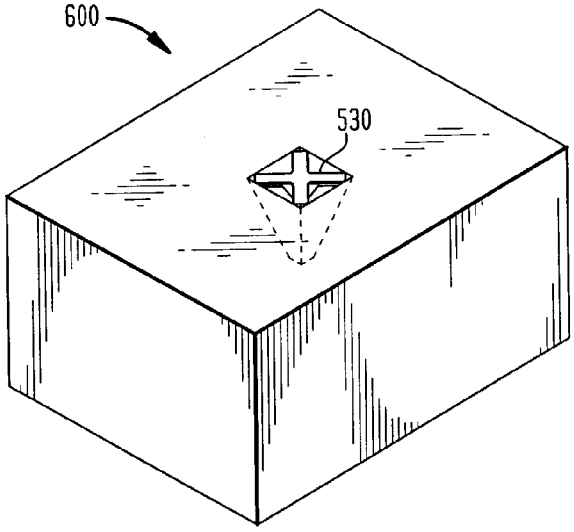
FIG. 6*c* is a perspective view drawing showing an embodiment of a die adapted for folding with the flashless metal positioned over the recess.
Figure 6D:
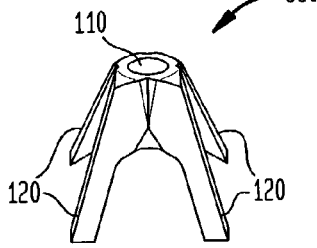
FIG. 6*d* is a perspective view drawing showing an embodiment of the folded metal.

FIGS. 6*a*–6*d* illustrate one embodiment for forcing the distal ends 130 of the prongs 120 to substantially face one another. In some embodiments, the prongs 120 are folded-up so that they face another. Initially, each of the prongs 120 extend radially from the base in a substantially coplanar manner as seen in the flashless metal 530. Each of these prongs 120 comprises an end distal to the base, references as a distal end 130. In forcing the distal ends 130 of the prongs 120 to substantially face one another, no differentiation should be made between forcing the distal ends 130 (e.g. pushing the distal ends and securing the base) and forcing the base 110 (e.g. pushing the base and securing the distal ends), since in both cases some force is applied to the distal ends 130 causing them to substantially face one another. In one embodiment, the flashless metal 530 is placed on top of a recess 610 in a die adapted for folding 600. The distal ends 130 should be facing upward. The base 110 is then pressed downward with folding press piece 620 by a pressing machine or other suitable means. As the base 110 moves downward, the distal ends 130 are forced to face one another. One embodiment of the resulting folded metal 630 is shown in FIG. 6*d*.

Figure 7A:
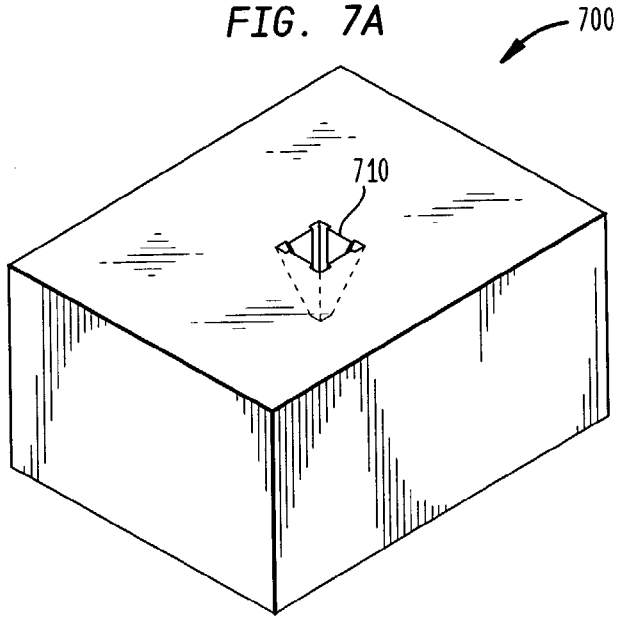
FIG. 7*a* is a perspective view drawing showing an embodiment of a female die.
Figure 7B:
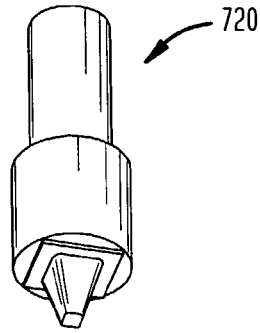
FIG. 7*b* is a perspective view drawing showing an embodiment of a male press piece.
Figure 7C:
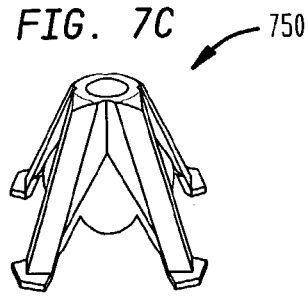
FIG. 7*c* is a perspective view drawing showing an embodiment of the shaped metal.

FIGS. 7*a*–7*c* illustrate one embodiment for forcing a solid against at least one of the distal ends 130 to form at least one receptacle end 140 adapted to confine the gem between the distal ends 130. In some embodiments, this shapes the receptacle end 140 into a substantially V-shaped end. Each of the distal ends 130 are initially unshaped and prong-like as shown in the folded metal 630. However, at least one receptacle end 140 is formed from a distal end 130 that is adapted to confine a gem between the distal ends 130. In some embodiments, the receptacle end 140 is substantially V-shaped. FIGS. 7*a*–7*c* illustrate a sample embodiment, where each of the four distal end 130 are formed into receptacle ends 140.

FIG. 7*a* illustrates an embodiment of what is referred to herein as a female die 700. The female die is made from the master hub 800, discussed below in further detail with reference to FIGS. 8*a*–8*c* and 12*a*–12*c*. FIG. 7*b* illustrates an embodiment of what is referred to herein as a solid 720, or in some embodiments, a male die. In the embodiment of FIG. 7*b*, the male die 720 comprises a press piece with smooth sides and operable by a press machine. However, in some embodiments, the sides of male die 720 may have raised, recessed and/or grooved sides to press an alternative shape. The folded metal 630 is inserted for shaping into the female die recess 710 with the base 110 pointing downwards and the prongs 120 pointing upwards. The male die 720 is then pressed between the distal ends 130 and, in some embodiments, is pressed all the way down the entire length of the prongs 120. In some embodiments, the base 110 is also pressed downward. FIG. 7*c* illustrates a sample of the shaped metal 750 after pressing.

In the illustrated embodiment, the solid 720 is pressed against the inner surface 160 of the distal ends 130 while the female die 700 secures the outer surface 170 of the distal ends 130. A sample illustration of the inner surface 160 and outer surface 170 is also found in FIG. 1*b*. This pressing forces at least the distal ends 130 into the form of a receptacle end 140. In some embodiments, the prongs 120 form a receptacle-like shape as well. In the illustrated embodiment, the receptacle ends 140 comprises substantially V-shaped receptacle end 140. While the use of a solid 720 and a female die 700 is discussed herein in detail, any shaping means capable of fully shaping a distal end 130 into receptacle end 140 may be used. Such shaping means may additionally include the shaping means discussed below with reference to FIGS. 9*a*–9*c* and 10*a*–10*c*.

Figure 8A:
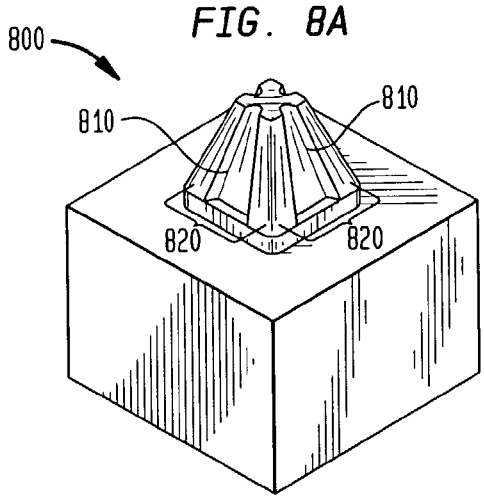
FIG. 8*a* is a perspective view drawing showing an embodiment of the master hub that created the female die.
Figure 8B:
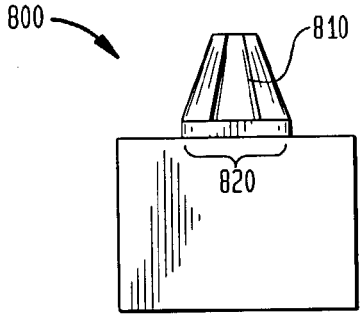
FIG. 8*b* is a side view drawing showing an embodiment of the master hub that created the female die.
Figure 8C:
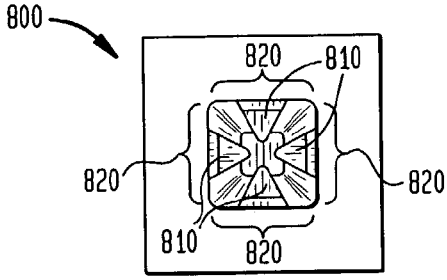
FIG. 8*c* is a top view drawing showing an embodiment of the master hub that created the female die.

FIGS. 8*a*–8*c* illustrate an embodiment of a master hub 800 used to form the recess 710 in the sample female die 700 of FIG. 7*a*. The surface structure of the master hub 800 defines the negative space of recess 710 and is thus reflected in the shape of at least the outer surface 170 of the setting 100. Each side 820 of the master hub 800 has negative space 810. The details of the surface structure and construction of the master hub 800 will be discussed in further detail below with reference to FIGS. 12*a*–12*c*.

Figure 9A:
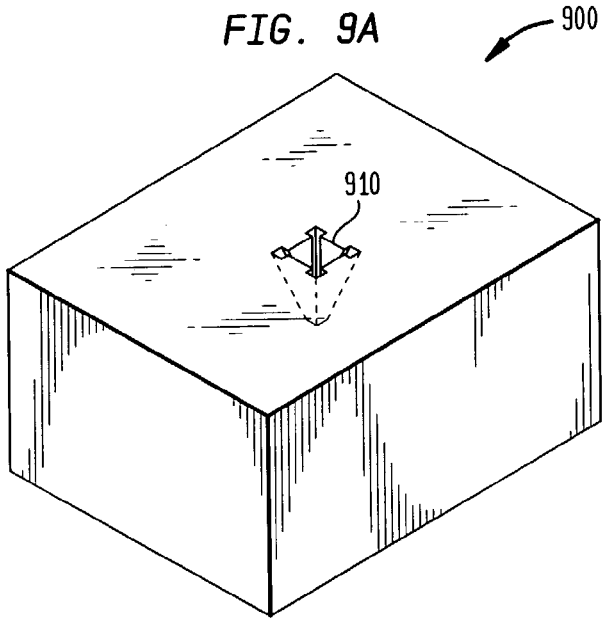
FIG. 9*a* is a perspective view drawing showing an embodiment of a die adapted for shaping.
Figure 9B:
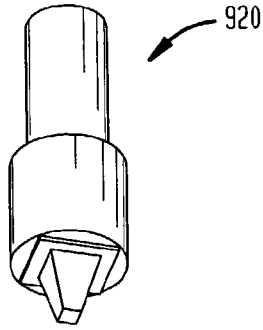
FIG. 9*b* is a perspective view drawing showing an embodiment of a press piece.
Figure 9C:
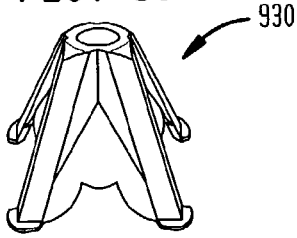
FIG. 9*c* is a perspective view drawing showing another embodiment of twice-shaped metal.

FIGS. 9*a*–9*c* illustrate an embodiment of a die adapted for further shaping 900. This die is used in some embodiments where the shaped metal 750 is shaped again. Double shaping is a process wherein the metal has an opportunity to be annealed between shapings. This helps ensure that the metal will not crack while being shaped. If additional shaping is desired, then the shaped metal 750 is placed inside the recess 910 of shaping die 900 and pressed with the press piece 920. In embodiments where shaping occurs twice, the recess 910 of shaping 900 is similar to recess 710, however the metal obtains the final shape over the course of two shapings. FIG. 9*c* illustrates an embodiment of twice-shaped metal 930.

Figure 10A:
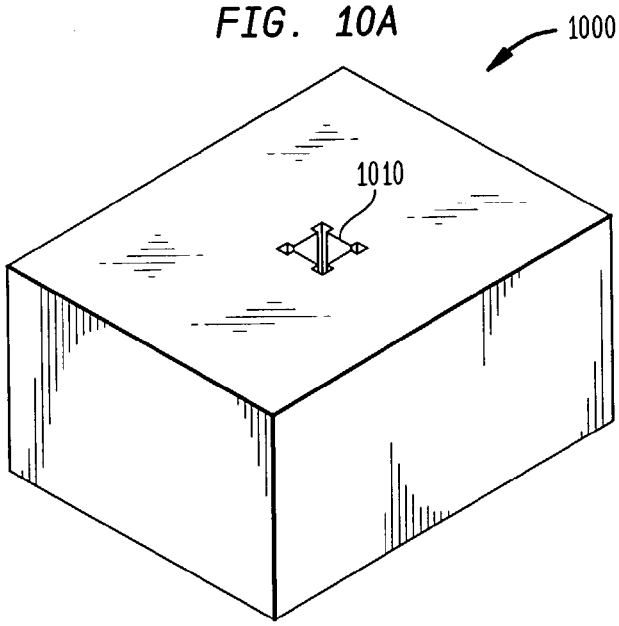
FIG. 10*a* is a perspective view drawing showing an embodiment of a shaping die.
Figure 10B:
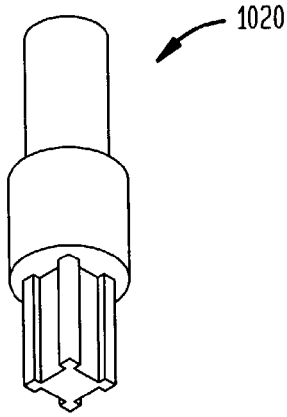
FIG. 10*b* is a perspective view drawing showing an embodiment of a press piece.
Figure 10C:
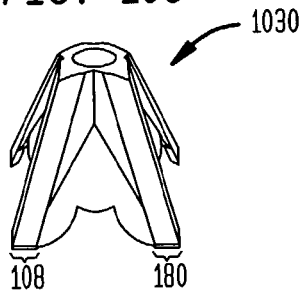
FIG. 10*c* is a perspective view drawing showing an embodiment of thrice-shaped metal.

FIGS. 10*a*–10*c* illustrate an embodiment of another die adapted for further shaping 1000. This die is used in some embodiments where the shaped metal 930 is shaped three times. As discussed above, multiple shapings allow for intermittent annealing, further minimizing the chances of the metal cracking. If additional shaping is desired, then the shaped metal 930 is placed inside the recess 1010 of shaping die 1000 and pressed with the press piece 1020. In one embodiment, the press piece 1020 is flat to help ensure that the top 180 of the prongs 120 are substantially coplanar. In embodiments where shaping occurs three times, the recess 1010 of shaping die 1000 is similar to recess 910 and recess 710, however the metal obtains its final shape over the course of three shapings. FIG. 10*c* illustrates an embodiment of thrice-shaped metal 1030.

Figure 11A:
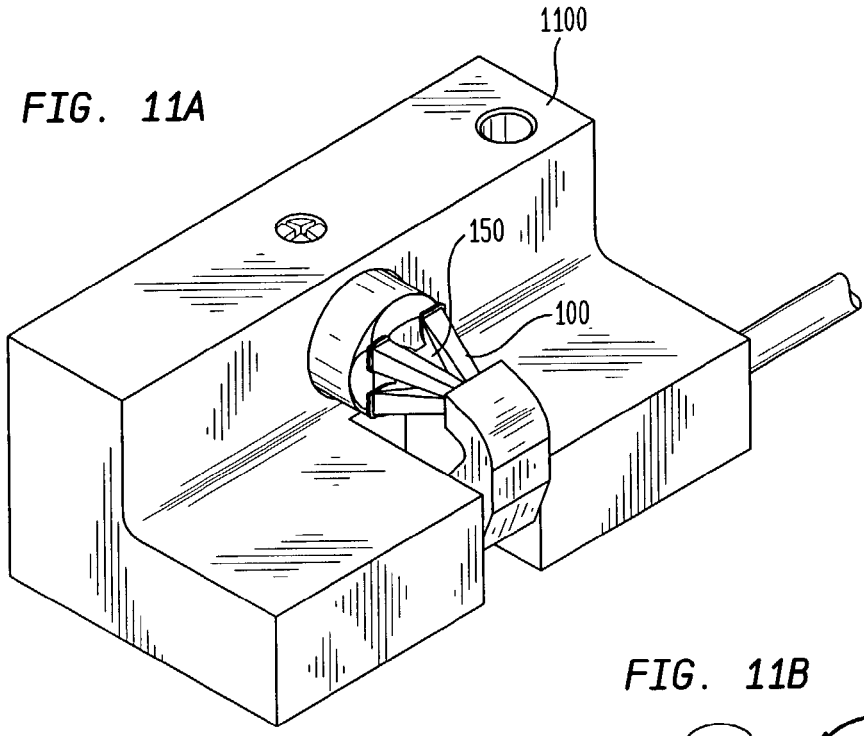
FIG. 11*a* is a perspective view drawing showing an embodiment of a clamp.
Figure 11B:
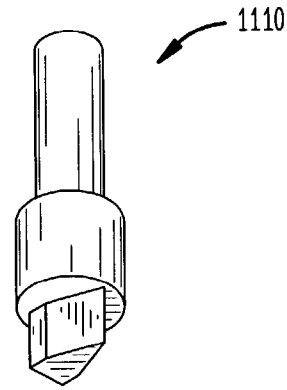
FIG. 11*b* is a perspective view drawing showing an embodiment of a press piece.
Figure 11C:
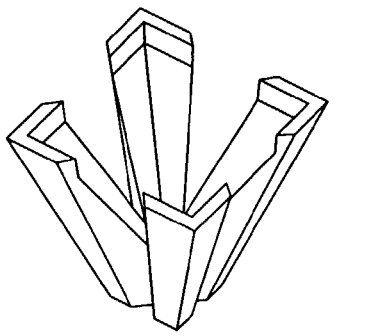
FIG. 11*c* is a perspective view drawing showing an embodiment of the setting.

FIGS. 11*a*–11*c* illustrate an embodiment for removing any additional flash 1040 that may have been formed from the metal. For example, the shaping process described in conjunction with the sample embodiments of FIGS. 7*a*–7*c*, 9*a*–*c*, and/or 10*a*–*c* forms additional flash 1040. Additional flash 1040 may be located, for example, between each of the prongs 120 as illustrated in FIG. 10*c*. FIG. 11*a* shows a sample clamp 1100 that can be used for securing the shaped, twice-shaped, or thrice-shaped metal during flash removal. FIG. 11*b* show a sample punch press piece 1110 that can be used to remove the additional flash 1040. The base 110 and prongs 120 are placed in the clamp 1100 with some of the additional flash 1040 facing upward and the punch press piece 1110 is lowered by the press machine to remove the upwardly facing additional flash 1040. The base 110 and prongs 120 are then rotated so that other additional flash 1040 is facing upward and the process is repeated until all of the additional flash 1040 is removed. Other means may be utilized to remove the additional flash 1040 and are known to those skilled in the art. In some embodiments, setting 100 comprises the remaining flashless metal 1130 as illustrated in FIG. 11*c*.

Figure 12A:
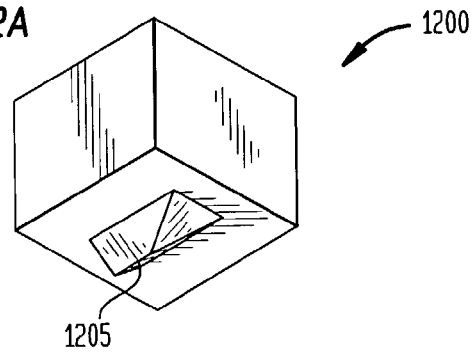
FIG. 12*a* is a perspective view drawing showing an embodiment of an intermediary hub.
Figure 12B:
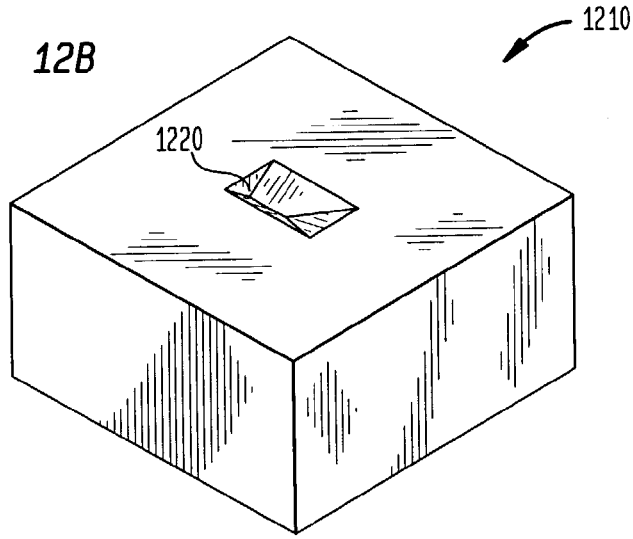
FIG. 12*b* is a perspective view drawing showing an embodiment of an intermediary die.
Figure 12C:
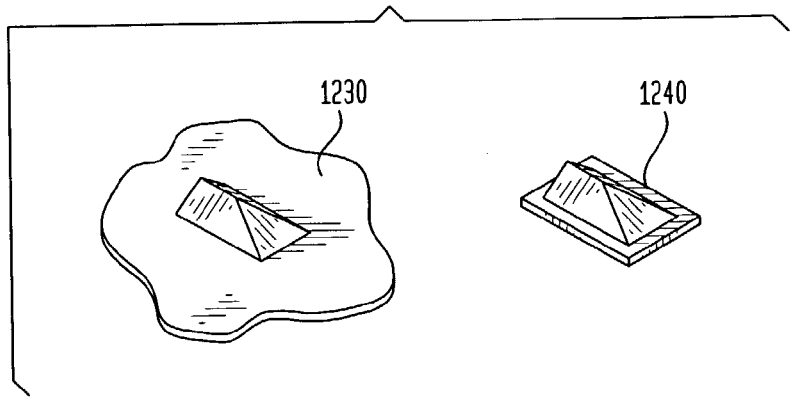
FIG. 12*c* is a perspective view drawing showing two embodiments of an electrode.

FIGS. 12*a*–12*c* illustrate an embodiment for forming the master hub 800 used for creating the recess 710 in the female die 700 of FIG. 7*a*. In the example embodiment of a setting 100 with four prongs 120 and four receptacle ends 140, the master hub 800 is formed from a recessless, pyramid-shaped hub (not shown). The pyramid-shaped has the surface structure of the master hub 800, absent the hub recesses 810. Thus, the surface structure of the staring hubs is flat and smooth rather than recessed, raised and/or grooved. In some embodiments, the hub recesses 810 are created with use of at least one an intermediary press 1200, at least one intermediary die 1210, and at least one electrode 1230. In the sample embodiment, each master hub side 820 is identical so only one set of intermediary presses 1200, intermediary dies 1210, and electrodes are required 1230. In other embodiments, such as those embodiments corresponding to the setting of FIGS. 1*d*–1*f*, for example, the master hub sides 820 will not be identical and multiple sets may be required.

Referring to FIG. 12*a*, the intermediary press piece 1200 has a raised surface structure 1205 corresponding to the desired structure for the inner surface 160 as it is embodied in the final setting 100. This raised surface structure 1205 is then pressed or otherwise impressed into an intermediary die 1210, thus creating a negative space 1220 representative of the inner surface 160 as it is embodied in the final setting 100. A sample intermediary die is illustrated in FIG. 12*b*.

Copper or another metal is then poured into the negative space 1220. Copper has been chosen in the sample embodiment because it is a good conduit for electricity and is easily adaptable to molding, however, any suitable metal may be used. The copper is allowed to cool, and when it solidifies, it has a surface structure corresponding to the inner surface 160 of the final setting 100 and can be used as an electrode 1230, such as the sample shown in FIG. 12*c*. It is further suitable for use after it is formed into a trimmed electrode 1240, also illustrated in FIG. 12*c*.

The electrode 1240 is then pressed against the starting hub and electricity is conducted through the electrode, thereby forming a hub recess 810. The process is then repeated for each hub side 810 to form the final master hub 800. In some embodiments, electrical discharge machining (EDM) is used to form the hub recess 810. However, other methods of creating master hub 800 are known in art and may be alternatively or additionally utilized in addition to method described herein.

Figure 13A:
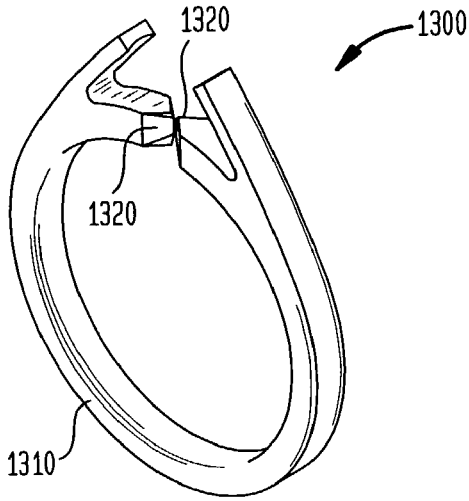
FIG. 13*a* is a perspective view drawing showing an embodiment of a shank.
Figure 13B:
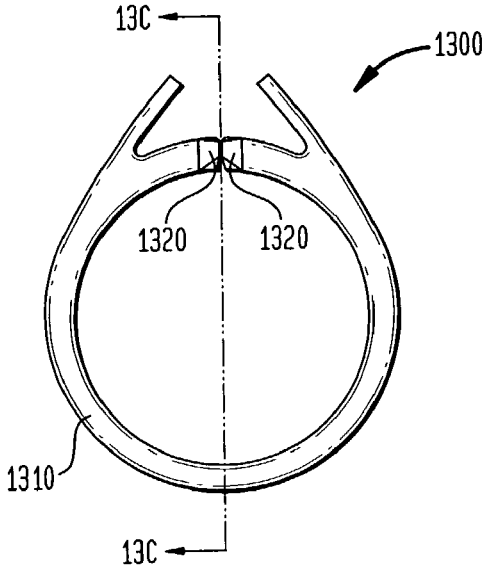
FIG. 13*b* is a front view drawing showing an embodiment of a shank.
Figure 13C:
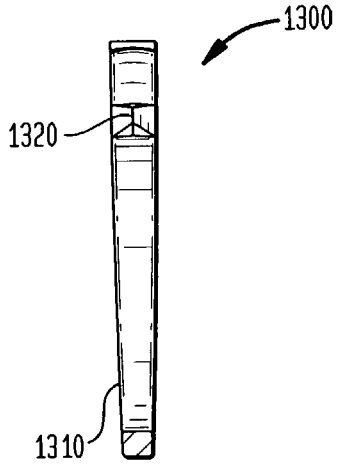
FIG. 13*c* is a sectional view drawing showing an embodiment of shank.
Figure 14A:
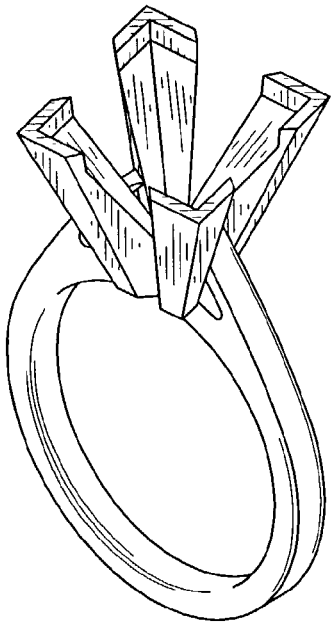
FIG. 14*a* is a perspective view drawing showing an embodiment of a setting and shank.
Figure 14B:
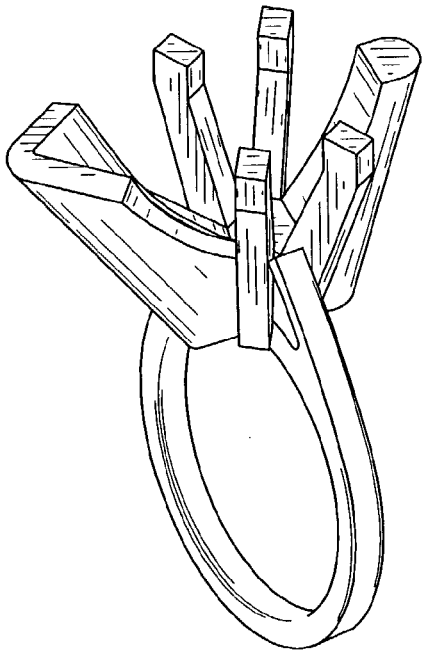
FIG. 14*b* is a perspective view drawing showing another embodiment of a setting and shank.

FIGS. 13*a*–13*c* illustrate a sample embodiment of a conventional shank 1300 for which the setting 100 may be mounted to. In some embodiments, the base 110 is adapted to be mounted on the shank 1300. In one embodiment, shank 1300 comprises a ring 1310 and a plurality of cut ends 1320, and a plurality of top ends 1330. Base 110 rests between the cut ends 1320 and the top ends 1330 rest in a groove 190 in the setting 100. A sample embodiment of groove 190 is illustrated in FIG. 1*a* for a four-prong setting 100 and in FIG. 1*f* for a six-prong setting. FIGS. 14*a*–14*b* illustrate some embodiments where the setting 100 is attached to the shank.

Although there has been hereinabove described a setting for gem, in accordance with the present invention and for the purposes of illustrating the manner in which the invention may be used to advantage, it should be appreciated that the invention is not limited thereto. Accordingly, any and all modifications, variations, or equivalent arrangements which may occur to one skilled in the art should be considered to be within the scope of the present invention as defined in the appended claims.

What is claimed is:

1. A method of forming a setting for a gem from a blank, comprising:

forcing the blank and at least one negative impression against one another to form simultaneously, from the blank, a base and at least three prongs each extending radially from the base in a substantially coplanar manner and each having an end distal to the base;

forcing the distal ends to substantially face one another; and forcing a solid against at least one of the distal ends to form at least one receptacle end adapted to confine the gem between the distal ends.

2. The method of claim 1, wherein forcing the solid comprises simultaneously pressing a male die against an inner surface of the at least one of the distal ends, and securing a female die against an outer surface of the at least one of the distal ends.

3. The method of claim 1, comprising using impressing means to force the blank and the at least one negative impression against one another.

4. The method of claim 1, wherein forcing the blank and the at least one negative impression against one another comprises pressing the blank against a stamping die having a base negative impression and at least three prong negative impressions.

5. The method of claim 1, comprising annealing the base and the at least three prongs.

6. The method of claim 1, comprising using shaping means to form the at least one receptacle end from the at least one of the distal ends.

7. The method of claim 1, wherein forcing the solid comprises shaping the at least one of the distal ends into at least one substantially V-shaped receptacle end.

8. The method of claim 7, wherein forcing the blank and the at least one negative impression against one another to form from the blank the base and the at least three prongs, comprises forcing the blank and at least one negative impression against one another to form from the blank, the base and four prongs, and wherein shaping the at least one of the distal ends into at least one substantially V-shaped receptacle end, comprises shaping four distal ends into four substantially V-shaped receptacle ends.

9. The method of claim 1, wherein forcing the blank comprises forcing the blank and the at least one negative impression against one another to form from the blank, a mountable base adapted for mounting in a conventional shank.

10. The method of claim 9, wherein forcing the solid comprises simultaneously pressing a male die against an inner surface of the at least one of the distal ends, and securing a female die against an outer surface of the at least one of the distal ends.

11. The method of claim 9, comprising using impressing means to force the blank and the at least one negative impression against one another.

12. The method of claim 9, wherein forcing the blank and the at least one negative impression against one another comprises pressing the blank against a stamping die having a base negative impression and at least three prong negative impressions.

13. The method of claim 9, comprising annealing the base and the at least three prongs.

14. The method of claim 9, comprising using shaping means to form the at least one receptacle end from the at least one of the distal ends.

15. The method of claim 9, wherein forcing the solid comprises shaping the at least one of the distal ends into at least one substantially V-shaped receptacle end.

16. The method of claim 15, wherein forcing the blank and the at least one negative impression against one another to form from the blank, the base and the at least three prongs, comprises forcing the blank and at least one negative impression against one another to form from the blank, the base and four prongs, and wherein shaping the at least one of the distal end into at least one substantially V-shaped receptacle end, comprises shaping four distal ends into four substantially V-shaped receptacle ends.

17. The method of claim 1, comprising forcing the blank and the negative impression against one another to form from the blank, the base, the at least three prongs, and flash;

removing the flash;

forcing the solid against the at least one of the distal ends to form the at least one receptacle end and additional flash; and removing the additional flash.

18. A method of forming a setting for a gem from a blank, comprising:

forcing the blank and at least one negative impression against one another to form from the blank, a base and at least three prongs each extending radially from the base in a substantially coplanar manner and each having an end distal to the base;

forcing the distal ends to substantially face one another;

forcing a solid against at least one of the distal ends to form at least one receptacle end adapted to confine the gem between the distal ends;

wherein forcing the solid comprises shaping the at least one of the distal ends into at least one substantially V-shaped receptacle end; and wherein forcing the blank and the at least one negative impression against one another to form from the blank the base and the at least three prongs, comprises forcing the blank and at least one negative impression against one another to form from the blank the base and four prongs, and wherein shaping the at least one of the distal ends into at least one substantially V-shaped receptacle end, comprises shaping four distal ends into four substantially V-shaped receptacle ends.

19. A method of forming a setting for a gem from a blank, comprising:

forcing the blank and at least one negative impression against one another to form from the blank, a base and at least three prongs each extending radially from the base in a substantially coplanar manner and each having an end distal to the base;

forcing the distal ends to substantially face one another;

forcing a solid against at least one of the distal ends to form at least one receptacle end adapted to confine the gem between the distal ends;

forcing the blank and the negative impression against one another to form, from the blank, the base, the at least three prongs, and flash;

removing the flash;

forcing the solid against the at least one of the distal ends to form the at least one receptacle and additional flash; and removing the additional flash.

20. A method of forming a setting for a gem from a blank, comprising:

forcing the blank and at least one negative impression against one another to form from the blank, a base and at least three prongs each extending radially from the base in a substantially coplanar manner and each having an end distal to the base;

forcing the distal ends to substantially face one another;

forcing a solid against at least one of the distal ends to form at least one receptacle end adapted to confine the gem between the distal ends;

wherein forcing the blank comprises forcing the blank and the at least one negative impression against one another to form from the blank, a mountable base adapted for mounting in a conventional shank;

wherein forcing the solid comprises shaping the at least one of the distal ends into at least one substantially V-shaped receptacle end; and wherein forcing the blank and the at least one negative impression against one another to form from the blank, the base and the at least three prongs, comprises forcing the blank and at least one negative impression against one another to form from the blank the base and four prongs, and wherein shaping the at least one of the distal end into at least one substantially V-shaped receptacle end, comprises shaping four distal ends into four substantially V-shaped receptacle ends.

21. A method of forming a setting for a gem from a blank, comprising:

pressing the blank against a stamping die having a base negative impression and at least three prong negative impressions to form in the blank, a base adapted for mounting in a conventional shank, flash, and at least three prongs each extending radially from the base in a substantially coplanar manner and each having an end distal to the base;

removing the flash;

forcing the distal ends to substantially face one another;

shaping the at least one of the distal ends into at least one substantially V-shaped receptacle by simultaneously pressing a male die against an inner surface of the at least one of the distal ends and securing a female die against an outer surface of the at least one of the distal ends, thereby forming additional flash; and removing the additional flash.

22. The method of claim 21, comprising annealing the base and the at least three prongs.

23. The method of claim 21, wherein pressing the blank against the stamping die to form the at least three prongs comprises pressing the blank against the stamping die to form four prongs, and wherein shaping the at least one of the distal ends into the at least one substantially V-shaped receptacle, comprises shaping the four distal ends into four substantially V-shaped receptacles.

24. A method of forming a setting for a gem, comprising:

providing a partially-formed setting having a base and at least three prongs each extending radially from the base in a substantially coplanar manner and each having an end distal to the base, wherein the base and the at least three prongs are formed simultaneously in the partially-formed setting;

forcing the distal ends to substantially face one another; and forcing a solid against at least one of the distal ends to form at least one receptacle end adapted to confine the gem between the distal ends.

25. The method of claim 24, wherein providing the partially-formed setting comprises providing an impressed-blank partially-formed setting.

26. The method of claim 24, wherein providing the partially-formed setting comprises providing a casted partially-formed setting.

27. The method of claim 24, wherein forcing the solid comprises shaping the at least one of the distal ends into a substantially V-shaped receptacle end.

28. The method of claim 27, wherein providing the partially-formed setting comprises providing four prongs, wherein forcing a solid comprises forcing a solid against four distal ends to form four receptacle ends.

29. The method of claim 24, wherein providing the partially-formed setting comprises providing the partially-formed setting having a mountable base adapted to be mounted in a conventional shank.

30. A method of forming a setting for a gem from a blank, comprising:

forcing the blank and at least one negative impression against one another to form simultaneously, from the blank, a base adapted for mounting in a conventional shank and at least three prongs each extending radially from the base in a substantially coplanar manner and each having an end distal to the base; and forcing the distal ends to substantially face one another.

31. The method of claim 30, comprising using impressing means to force the blank and the at least one negative impression against one another.

32. The method of claim 30, wherein forcing the blank and the at least one negative impression against one another comprises pressing the blank against a stamping die having a base negative impression and at least three prong negative impressions.

33. The method of claim 30, comprising annealing the base and the at least three prongs.

34. The method of claim 30, wherein forcing the blank and the at least one negative impression against one another to form from the blank the base and the at least three prongs, comprises forcing the blank and at least one negative impression against one another to form from the blank the base and four prongs.

* * * * *